US007510446B1

(12) United States Patent
Yu et al.

(10) Patent No.: US 7,510,446 B1
(45) Date of Patent: Mar. 31, 2009

(54) MULTIPLE-FUNCTION POWER SUPPLY ADAPTER

(76) Inventors: Kuo-Ming Yu, 14F., No.343. Jhonghe Rd., Yonghe City, Taipei County 234 (TW); Kuo-Chin Huang, 14F., No.343. Jhonghe Rd., Yonghe City, Taipei County 234 (TW)

( * ) Notice: Subject to any disclaimer, the term of this patent is extended or adjusted under 35 U.S.C. 154(b) by 0 days.

(21) Appl. No.: 11/933,510

(22) Filed: Nov. 1, 2007

(51) Int. Cl.
*H01R 33/88* (2006.01)

(52) U.S. Cl. ..... 439/638; 439/501; 439/669

(58) Field of Classification Search ..... 439/4, 439/501, 668, 669, 682, 638
See application file for complete search history.

(56) References Cited

U.S. PATENT DOCUMENTS 5,564,943 A * 10/1996 Weiss ..... 439/502
6,994,592 B1 * 2/2006 Gannon ..... 439/638
2007/0238350 A1 * 10/2007 Azoulay ..... 439/501

* cited by examiner

*Primary Examiner*—Khiem Nguyen

(57) ABSTRACT

A multiple-function power supply adapter includes a supporting base with an interior thereof hollowed out, a power-supplying sleeve provided on the supporting base, and a transforming unit provided in the supporting base. The power-supplying sleeve is an automobile power-supplying socket. The transforming unit is electrically connected between a power supply line and the power-supplying sleeve. The power supply line extends from the inside of the supporting base to the outside thereof. The distal end of the power supply line is provided with a power supply plug. With the automobile power-supplying sleeve, the power supply adapter can be applied to various electrical appliances.

13 Claims, 8 Drawing Sheets

MULTIPLE-FUNCTION POWER SUPPLY ADAPTER

BACKGROUND OF THE INVENTION

1. Field of the Invention

The present invention relates to an accessory of an electrical appliance, and in particular to a power supply adapter for an electrical appliance, which can be applied to various electrical appliances.

2. Description of Prior Art

The cigar-lighter commonly used in an automobile is lodged in a charging socket provided in the automobile so as to be heated by electricity. In this way, the cigar-lighter generates a high temperature to allow a user to light up a cigarette.

However, such a convenient cigar-lighter can be merely used in the automobile. If someone intends to light up a cigarette in a room, he/she still needs to use a lighter or the like which is not as rapid and convenient in operation as the automobile cigar-lighter because the lighter has to utilize liquefied gas to ignite a flame. Therefore, there is a possibility that the fuel may be used up and such a lighting operation is somewhat dangerous.

As for a common small night lamp, since it has to be inserted into a socket provided in a wall corner of a house, the illuminating region thereof will be limited by the location of the socket. Although an extension line can be used to extend the power supply, the socket of the extension line cannot be located firmly, so that it is not suitable to be arranged on a table or other locations.

According to the above, in order to solve the above-mentioned drawbacks, the inventor proposes the present invention based on his deliberate research.

SUMMARY OF THE INVENTION

The present invention is to provide a multiple-function power supply adapter, in which an automobile power-supplying socket is electrically connected to an automobile cigar-lighter, so that the automobile cigar-lighter can be disposed on a table or the like for use without being limited to an automobile only.

The present invention is to provide a multiple-function power supply adapter. With the above-mentioned automobile power-supplying socket, the electricity can be supplied to various electrical appliances such as a small night lamp, electrical heater or the like, so that those electrical appliances can be disposed on a table or other locations without being limited to the socket in a wall corner.

The present invention is to provide a multiple-function power supply adapter, which includes a supporting base with an interior thereof hollowed out, a power-supplying sleeve provided on the supporting base, and a transforming unit provided in the supporting base. The power-supplying sleeve is an automobile power-supplying socket. The transforming unit is electrically connected between a power supply line and the power-supplying sleeve. The power supply line extends from the inside of the supporting base to the outside thereof. The distal end of the power supply line is provided with a power supply plug. Via the above arrangement, the power supply adapter can be obtained.

DETAILED DESCRIPTION OF THE INVENTION

In order to make the Examiner to further understand the characteristics and technical contents of the present invention, a detailed description relating thereto will be made with reference to the accompanying drawings. However, it should be understood that the drawings are illustrative only but not to limit the present invention.

Figure 1:
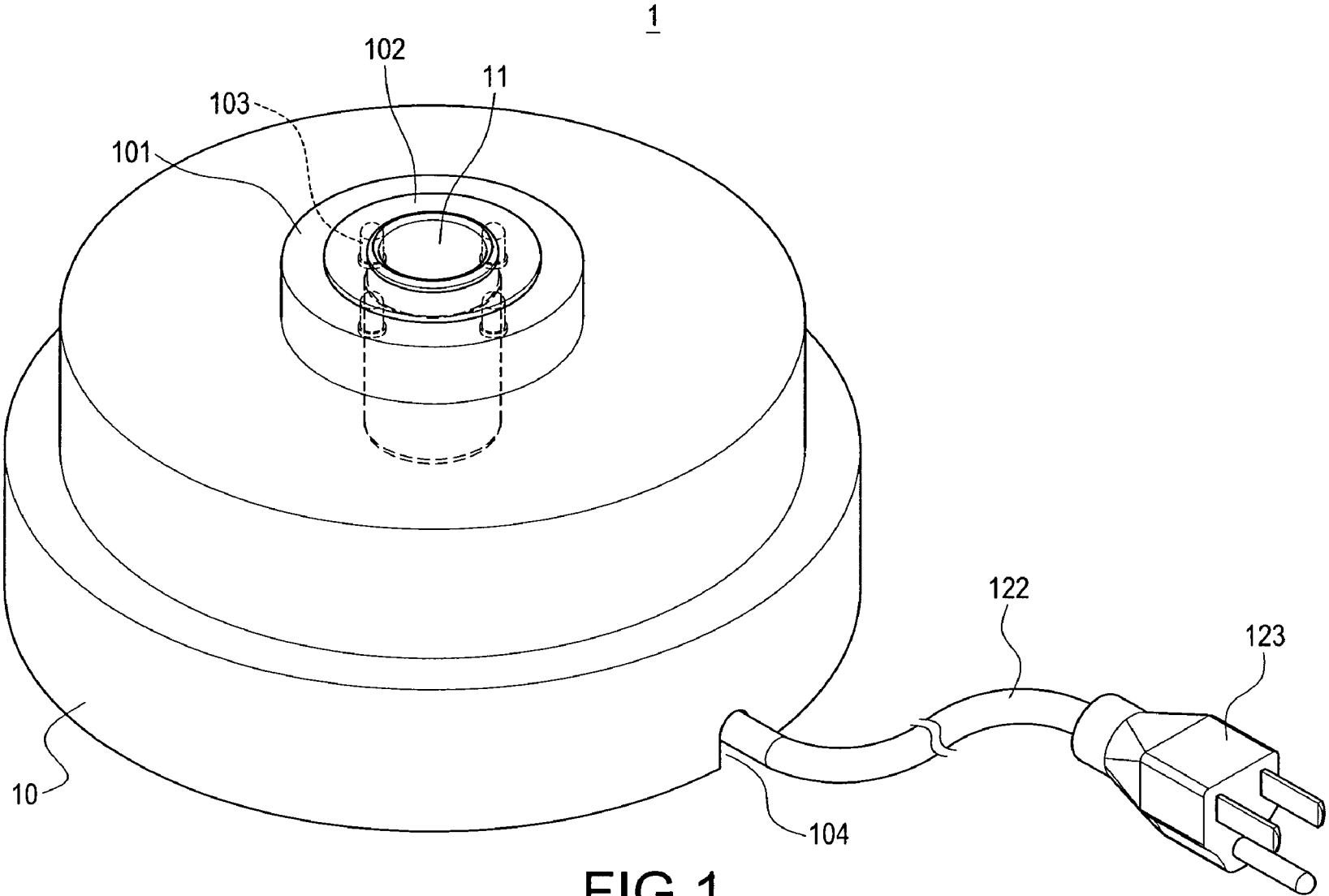
FIG. 1 is a schematic view showing the external appearance of the present invention.
Figure 2:
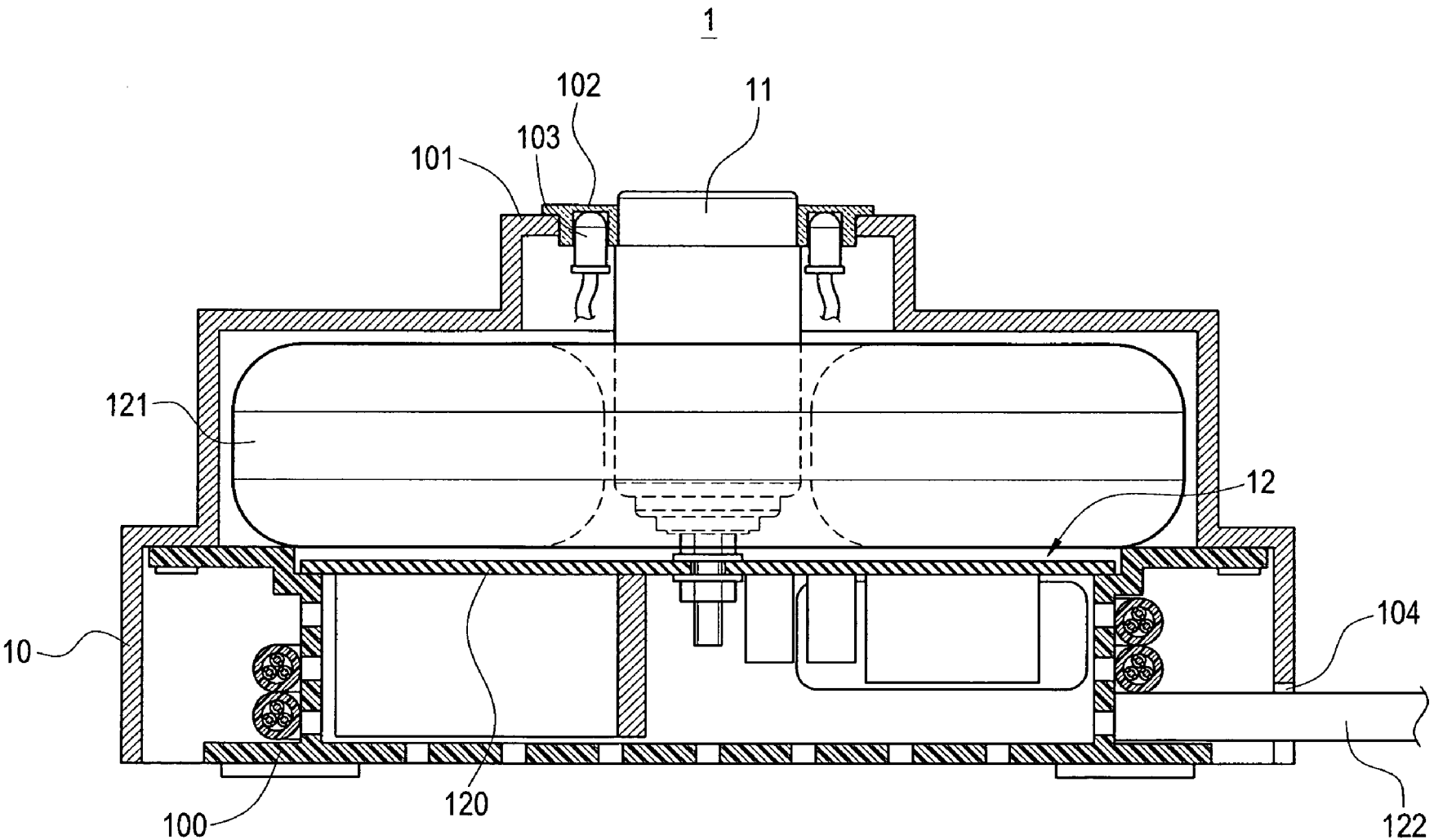
FIG. 2 is a cross-sectional view of the present invention.

FIG. 1 is a schematic view showing the external appearance of the present invention, and FIG. 2 is a cross-sectional view of the present invention. The present invention provides a multiple-function power supply adapter 1 that can be applied to various electrical appliances, such as a cigar-lighter, a small night lamp, an electrical heater or other electric devices. The power supply adapter 1 includes a supporting base 10, a power-supplying sleeve 11 and a transforming unit 12.

The supporting base 10 is used to support each of the above-mentioned electrical appliances, so that the electrical appliance can be placed on a table or other locations via the supporting base 10, thereby facilitating a user to use it nearby. In the illustrated embodiment of the present invention, the supporting base 10 has a profile similar to a disk base. The interior of the supporting base is hollowed out to allow the transforming unit 12 to be disposed therein. The interior of the supporting base 10 is provided with a winding disk 100 for winding and accommodating a power supply line 122 described later. The supporting base 10 is provided with an annular positioning portion 101 thereon. The positioning portion 101 is located substantially in the center of the top surface of the supporting base 10 for positioning the associated electrical appliance, so that the electrical appliance can be supported on the supporting base 10 firmly.

The power-supplying sleeve 11 is a common automobile power-supplying socket, which is a commonly used and standardized component. The power-supplying sleeve 11 is provided upright in the positioning portion 101 of the supporting base 10, so that the electricity can be delivered to the associated electrical appliance with a plug thereof being inserted into the power-supplying sleeve 11. Further, the positioning portion 101 is provided thereon with a transparent cover 102 for covering on the power-supplying sleeve 11. The underside of the transparent cover 102 is provided with a plurality of light-emitting elements 103 around the periphery of the power-supplying sleeve 11. Each of the light-emitting elements 103 can be a light-emitting diode (LED), so that the user can determine whether the electricity is supplied or not based on the lighting of the LED.

The transforming unit 12 is provided in the interior of the supporting base 10, and is further located in the winding disk 100. The transforming unit 12 comprises a circuit board 120, a coil assembly 121 electrically connected to the circuit board 120, and a plurality of capacitors provided on the circuit board 120. Each of the capacitors is electrically connected with the power-supplying sleeve 11 and in turn the power supply line 122 via the circuit board 120. The power supply line 122 extends from the inside of the supporting base 10 to the outside thereof, and is provided with a power supply plug 123 that is inserted into a household socket. With the transforming unit 12 lowering the household voltage 110V to a voltage of 12V, each of the above-mentioned electrical appliances can be used. Since the principle of voltage transformation belongs to prior art and is not within the claimed scope of the present invention, the description thereof is omitted.

In order to facilitate the power supply line 122 to extend from the interior of the supporting base 10, the supporting base 10 is provided with a notch 104 for allowing the power supply line 122 to pass through, thereby avoiding from pressing and damaging the power supply line 122 when the supporting base 10 is positioned horizontally.

Therefore, with the above structural constitution, the multiple-function power supply adapter of the present invention can be obtained.

Figure 3:
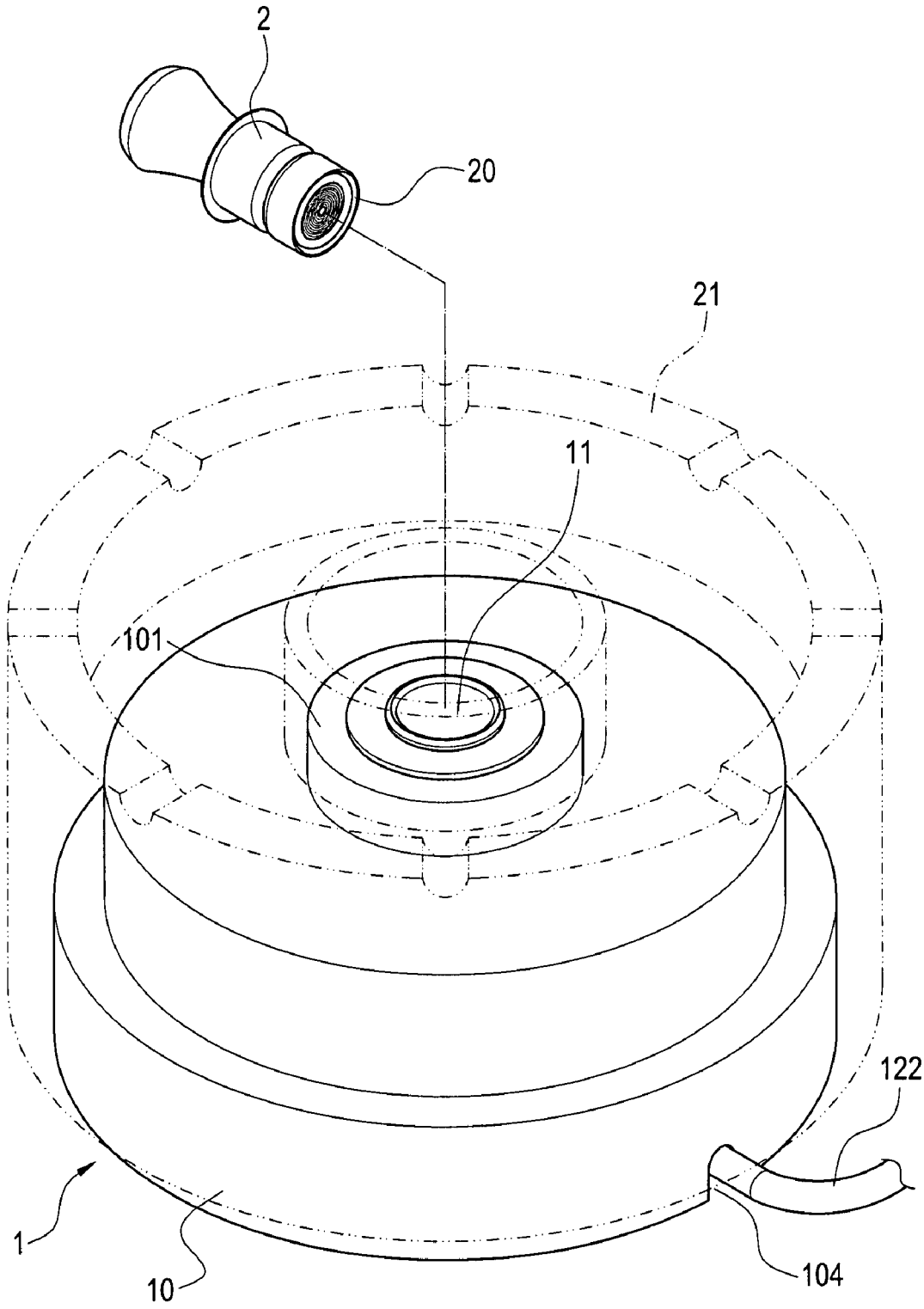
FIG. 3 is an exploded view showing that the present invention is applied to an automobile cigar-lighter.
Figure 4:
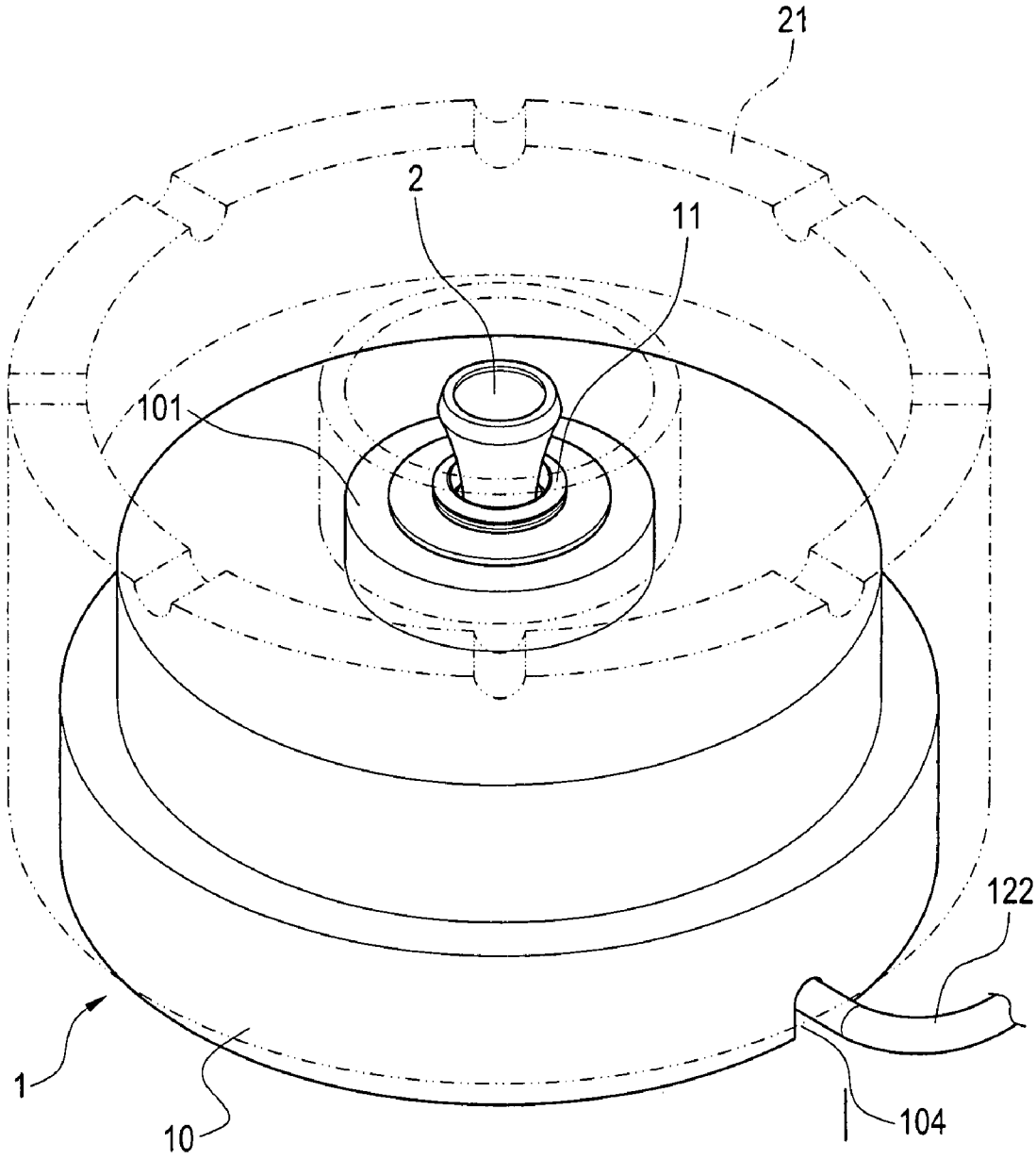
FIG. 4 is an assembled view showing that the present invention is applied to an automobile cigar-lighter.
Figure 5:
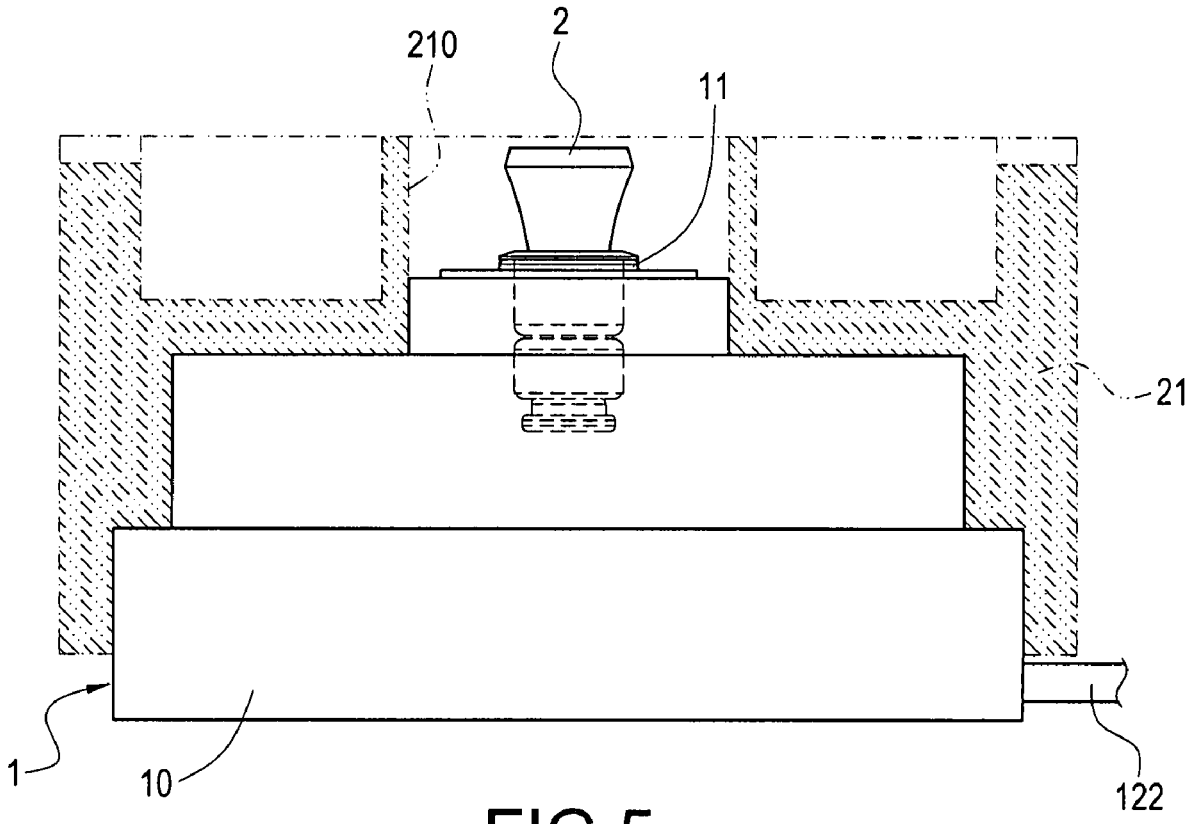
FIG. 5 is a plan view showing that the present invention is applied to an automobile cigar-lighter.

With reference to FIGS. 3 and 4, the power supply adapter 1 can be applied to an automobile cigar-lighter 2. With a plug 20 of the cigar-lighter 2 being inserted into the power-supplying sleeve 11, the power-supplying adapter 1 can heat the cigar-lighter 2, so that the user can light up a cigarette by using the cigar-lighter. Further, as shown in FIG. 5, when using the cigar-lighter 2, an ashtray 21 can straddle on the supporting base 10. The center of the ashtray 21 is provided with a hole 210 for allowing the positioning portion 101 of the supporting base 10 to be inserted therein. In this way, the present invention can be used in a situation that a smoker is allowed to light up a cigarette and cast the cigarette ash or the cigarette butt.

Figure 6:
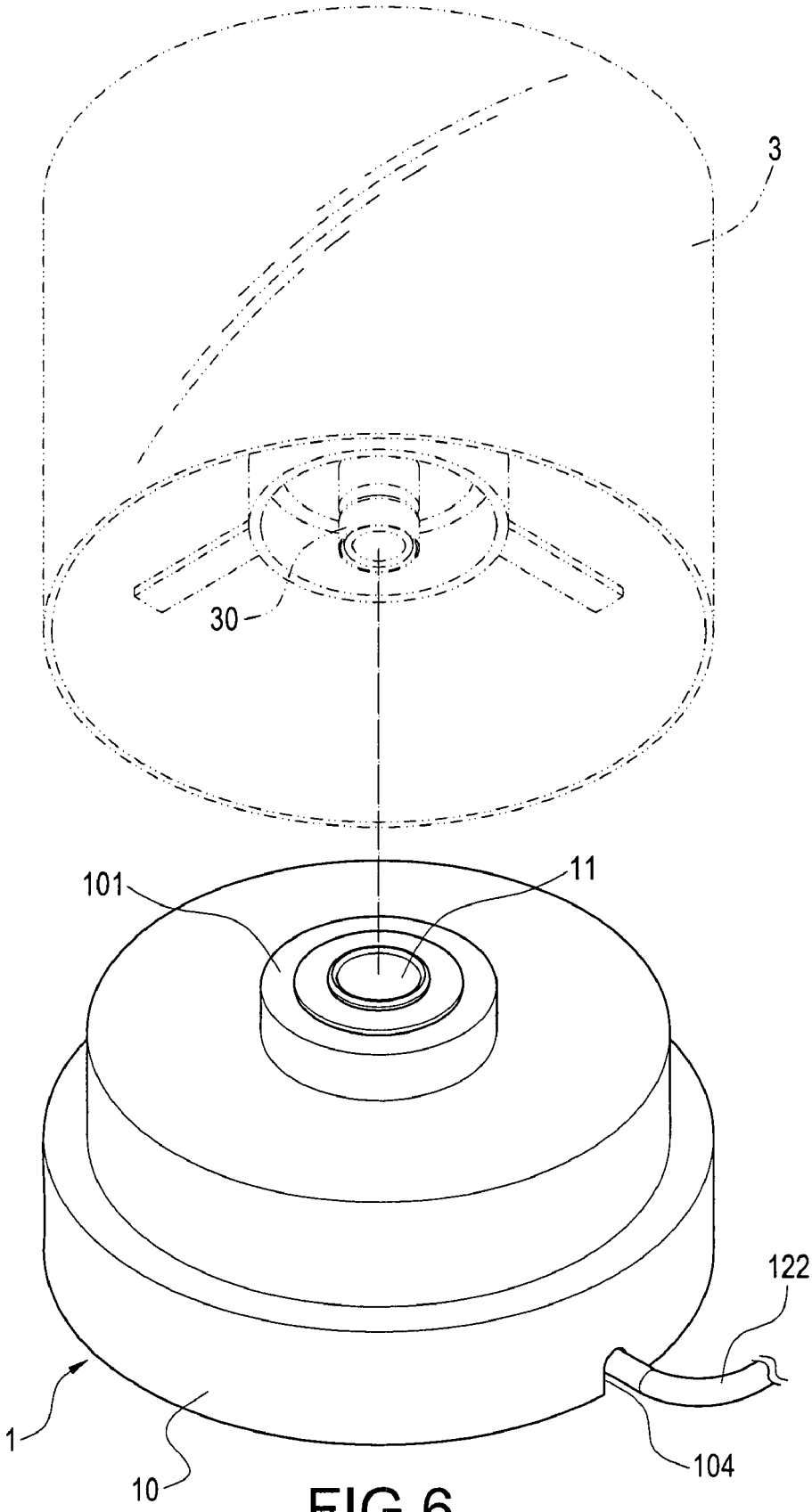
FIG. 6 is an exploded view showing that the present invention is applied to a small night lamp.
Figure 7:
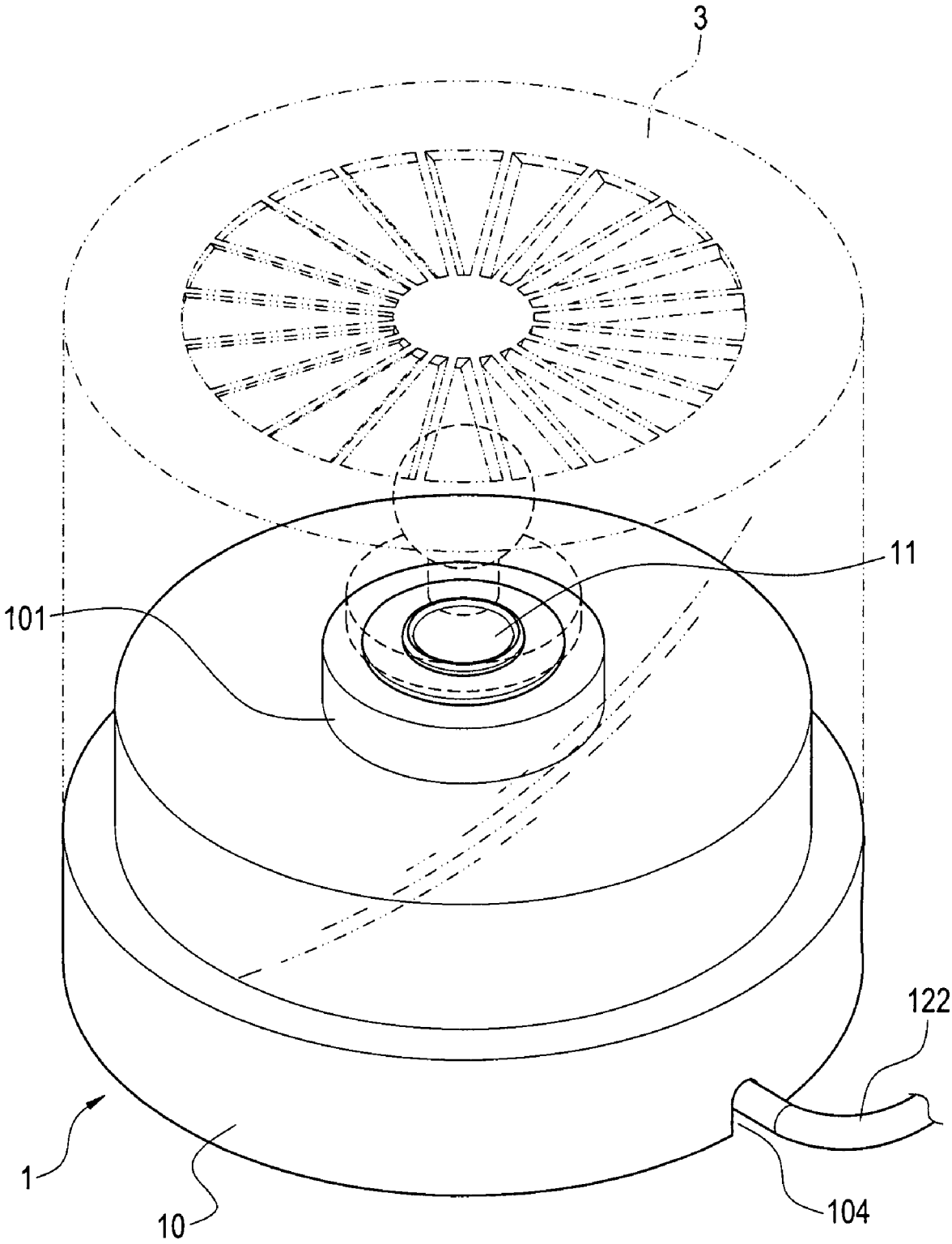
FIG. 7 is an assembled view showing that the present invention is applied to a small night lamp.

As shown in FIGS. 6 and 7, the power supply adapter 1 is applied to a small night lamp 3. With a power supply plug 30 of the small night lamp 3 being inserted into the power-supplying sleeve 11, the small night lamp 3 can be disposed on any plane such as a table without being limited to a wall corner.

Figure 8:
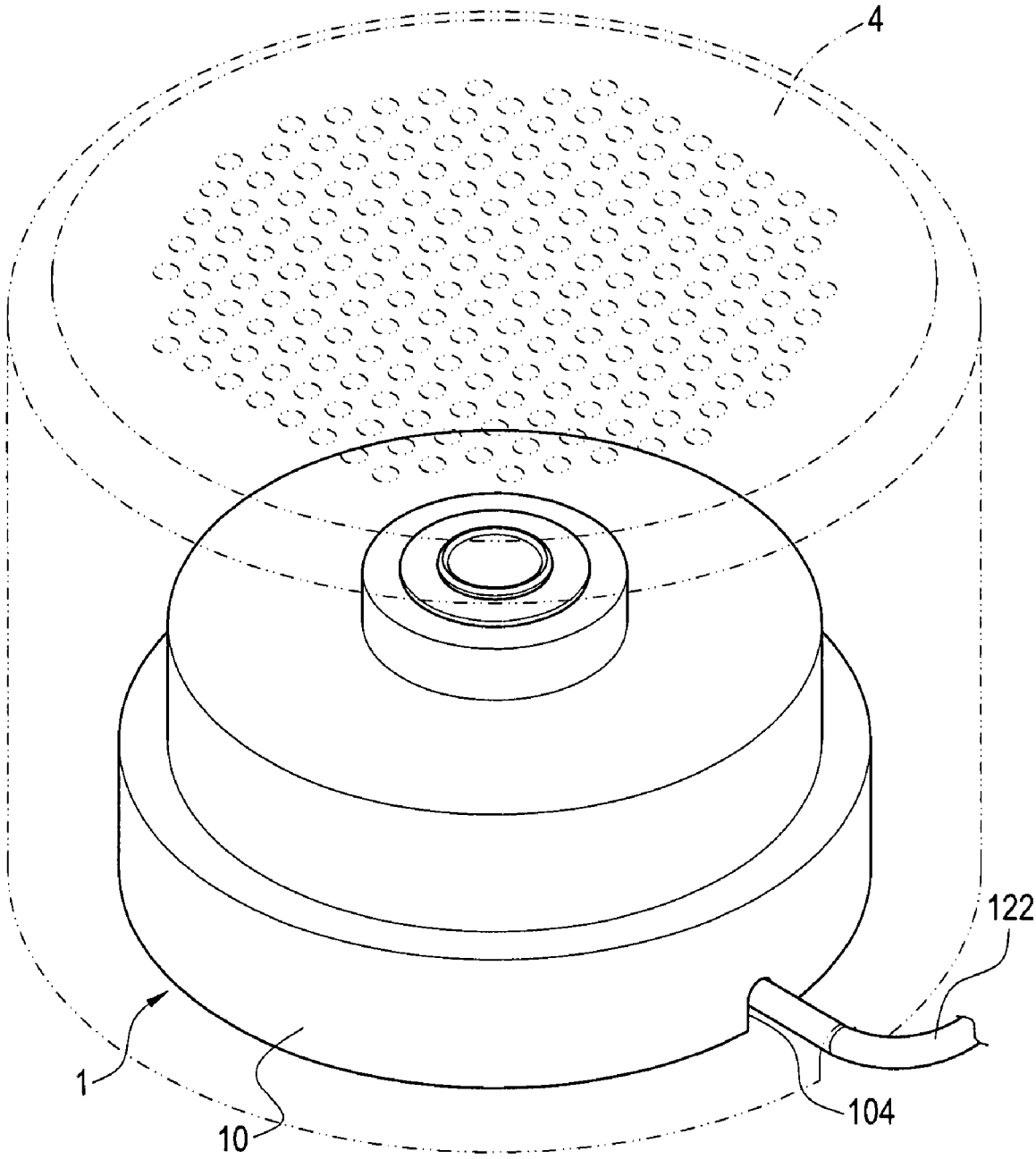
FIG. 8 is an assembled view showing that the present invention is applied to an electrical heater.

Further, as shown in FIG. 8, the power supply adapter 1 is applied to an electrical heater 4. Via the above-mentioned manner, the electrical heater 4 can be mounted on the power supply adapter 1. Of course, with a suitable plug of the other electrical appliance being inserted into the automobile power-supplying socket, the power supply adapter 1 can be applied to various electrical appliances.

According to the above, the present invention achieves the desired objects and solves the drawbacks of prior art. Further, the present invention has novelty and inventive steps and thus conforms to the requirement for a utility model patent.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A multiple-function power supply adapter, comprising:

a supporting base with a hollow interior;

a power-supplying sleeve being an automobile power-supplying socket and provided in the hollow interior of the supporting base; and a transforming unit provided in the supporting base and electrically connected between a power supply line and the power-supplying sleeve, the power supply line extending from inside of the supporting base to outside thereof, a distal end of the power supply line being provided with a power supply plug.

2. The multiple-function power supply adapter according to claim 1, wherein the supporting base has a profile of a disk base.

3. The multiple-function power supply adapter according to claim 1, wherein the interior of the supporting base is provided with a winding disk for winding and accommodating the power supply line.

4. The multiple-function power supply adapter according to claim 1, wherein the supporting base is provided thereon with a positioning portion for allowing an associated electrical appliance to be disposed on the supporting base.

5. The multiple-function power supply adapter according to claim 1, wherein the supporting base is provided with light-emitting elements to allow a user to determine whether the electricity is supplied based on the lighting of the light-emitting element.

6. The multiple-function power supply adapter according to claim 5, wherein the light-emitting element is a light-emitting diode.

7. The multiple-function power supply adapter according to claim 5, wherein a plurality of light-emitting elements are provided on the periphery of the power-supplying sleeve.

8. The multiple-function power supply adapter according to claim 7, wherein a transparent cover is provided on the light-emitting element.

9. The multiple-function power supply adapter according to claim 1, wherein the supporting base is provided with a notch for allowing the power supply line to pass through.

10. The multiple-function power supply adapter according to claim 1, further comprising an automobile cigar-lighter to be engaged in the power-supplying sleeve.

11. The multiple-function power supply adapter according to claim 10, further comprising an ashtray installed on the supporting base.

12. The multiple-function power supply adapter according to claim 1, wherein the multiple-function power supply adapter is applied to a small night lamp.

13. The multiple-function power supply adapter according to claim 1, wherein the multiple-function power supply adapter is applied to an electrical heater.

* * * * *